US005854477A

United States Patent [19]

Kawaji et al.

[11] Patent Number: 5,854,477

[45] Date of Patent: Dec. 29, 1998

[54] REUSABLE TICKET PROCESSING APPARATUS AND TICKET REGENERATING APPARATUS

[75] Inventors: Masatoshi Kawaji; Yoshio Murakami; Toshihiro Ikeda, all of Tokyo, Japan

[73] Assignee: Oki Electric Industry Co., Ltd., Tokyo, Japan

[21] Appl. No.: 870,595

[22] Filed: Jun. 6, 1997

[30] Foreign Application Priority Data

Jun. 7, 1996 [JP] Japan ..... 8-145831

[51] Int. Cl.[6] ..... G07B 15/02

[52] U.S. Cl. ..... 235/384; 235/493

[58] Field of Search ..... 235/384, 493

[56] References Cited

U.S. PATENT DOCUMENTS 3,958,103 5/1976 Oka et al. ..... 235/384

FOREIGN PATENT DOCUMENTS 63-265362 11/1988 Japan .

*Primary Examiner*—Harold Pitts
*Attorney, Agent, or Firm*—Rabin & Champagne, P.C.

[57] ABSTRACT

A ticket processing apparatus for reusable tickets, having a thermal print portion capable of repeatedly printing by heating at a predetermined write temperature and deleting the printed characters and the like by heating at a deletion temperature, and also capable of setting information about the number of printing times, wherein a control unit 23 causes a magnetic read head 10 to read reservation information and information about the number of printing done from a magnetic recording stripe 1*b* of a reservation airline ticket 1, and also causes a thermal head 8 to heat a thermal print portion 1*a* of the reservation airline ticket 1 at a deletion temperature to delete printed reservation information of the thermal print portion 1*a*, and when the number of times printing done of the reservation airline ticket 1 is less than a preset value, causes the thermal head 8 to print real-ticket information on the thermal print portion 1*a* and also causes information about the number of printing done added with "1" to be written on the magnetic stripe 1*b*, and if the reservation airline ticket 1 is not reusable, causes a stored boarding ticket 15 to be paid out from a ticket storage 3, and causes real-ticket information to be printed on the thermal print portion 1*a* and causes real-ticket information and information about the number of times of printing done added with "1" to be printed on the magnetic stripe 1*b* of the ticket 1.

6 Claims, 16 Drawing Sheets

REUSABLE TICKET PROCESSING APPARATUS AND TICKET REGENERATING APPARATUS

BACKGROUND OF THE INVENTION

1. Field of the Invention

The present invention relates to a ticket processing apparatus for processing reservation tickets, boarding tickets and special boarding tickets or the like in passenger transportation facilities and also relates to a ticket regenerating apparatus.

2. Prior Art

As shown in Japanese Patent Publication No. 6-38262, conventionally, the ticket processing apparatus reads information from a reservation ticket inserted, and according to the input information, issues a real ticket.

For example, the ticket processing apparatus for air fares receives a reservation ticket for boarding an airline, reads a passenger name, a leg, a reservation number, etc. from a magnetic recording stripe on the ticket, and by using some of those items of information, the clerk enters a flight to go on board, a departure time, a boarding gate number, and so on, to arrange all necessary items of information, then the apparatus prints those items of information on a boarding ticket (real ticket), which has been stored in the apparatus, and issues a boarding ticket. The reservation ticket is recovered. This is how a boarding ticket has conventionally been issued.

However, because it is necessary to collect reservation tickets and have real tickets stored in the apparatus, the prior-art ticket processing apparatus must have a reservation ticket collection box and a real ticket storage, which occupy a large space, and therefore has a shortcoming of its size having to be large.

It is a possible idea to reduce the size of the ticket collection box and the ticket storage, in which case, however, it is required to take out the collected reservation tickets from the apparatus and replenish real tickets in the ticket storage in a short time. This is the problem in ticket management.

SUMMARY OF THE INVENTION

The object of the present invention is to provide a ticket processing apparatus for reusable tickets, which features simplified ticket management and reduced apparatus construction.

According to the present invention, there is provided a ticket processing apparatus for reusable tickets, having a thermal print portion capable of repeatedly printing by heating at a predetermined write temperature and deleting the printed characters and the like by heating at a deletion temperature, and also capable of setting information about the number of times of printing done, the ticket processing apparatus comprising:

printed-character-deletion heating means for deleting reservation information by heating a thermal print portion of a reservation ticket at a deletion temperature when a reusable reservation ticket on which reservation information has been printed is inserted;

reuse decision means for deciding whether or not the reservation ticket is reusable by reading the information about the number of times of printing done on the reservation ticket;

real ticket conversion means for, when the reuse decision means decides that the reservation ticket is reusable, converting the reservation ticket into a real ticket by printing real-ticket information on the thermal print portion of the reservation ticket by controlling a thermal head, and issuing a real ticket;

storage means for storing a reusable ticket as a real ticket in store;

stored real ticket issuing means for, when the reuse decision means decides that the reservation ticket is not reusable, taking out a stored real ticket, and printing real-ticket information on the thermal print portion of the stored real ticket by controlling the thermal head; and number-of-times updating means for updating the number of times of printing done on a real ticket to be issued.

Further, according to the present invention, there is also provided a ticket regenerating apparatus which cleans reusable tickets, deletes the printed characters and so on by heating, and stores reusable tickets in the storage.

DESCRIPTION OF THE PREFERRED EMBODIMENTS

Embodiments of the present invention will be described with reference to the accompanying drawings.

Figure 3A:
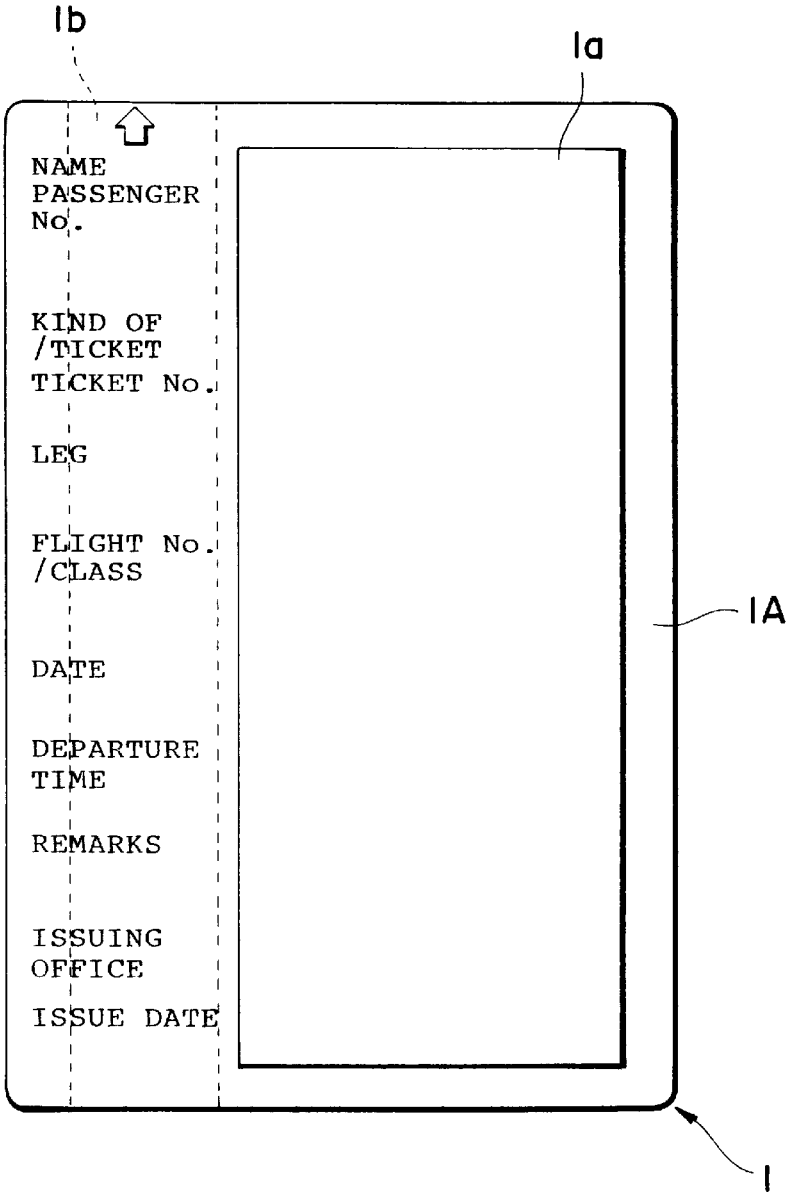
FIGS. 3(A) and 3(B) are front view and plan view of a reusable ticket according to the present invention.
Figure 3B:
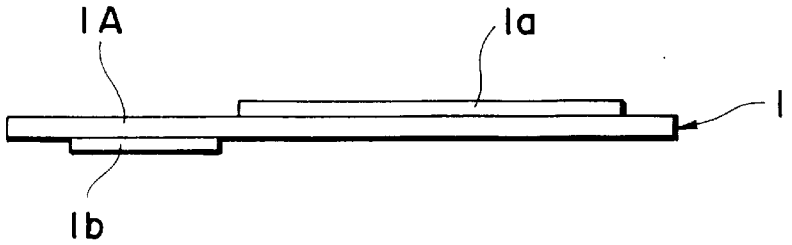

FIGS. 3(A) and 3(B) are a front view and a plan view of a reusable ticket as a processing object in the present invention.

This reusable ticket 1 has a main body 1A in rectangular form, made of polyethylene terephthalate or the like and measuring 54 mm×85.6 mm, for example. A thermal print portion 1*a* is provided on one side of the main body 1A. The thermal print portion 1*a* includes a thermal recording layer formed by mixing polyvinyl acetal and higher fatty acid, for example, and is capable of printing by heating with the thermal head at a predetermined write temperature, and can also delete the printed characters by further heating with heating means at a predetermined deletion temperature (high temperature). The thermal print portion 1*a* can be printed on and can also have the printed characters deleted 1,000 times, for example.

On the other side of the main body 1A, there is provided a magnetic stripe 1*b* on which to record magnetic information.

Figure 4:
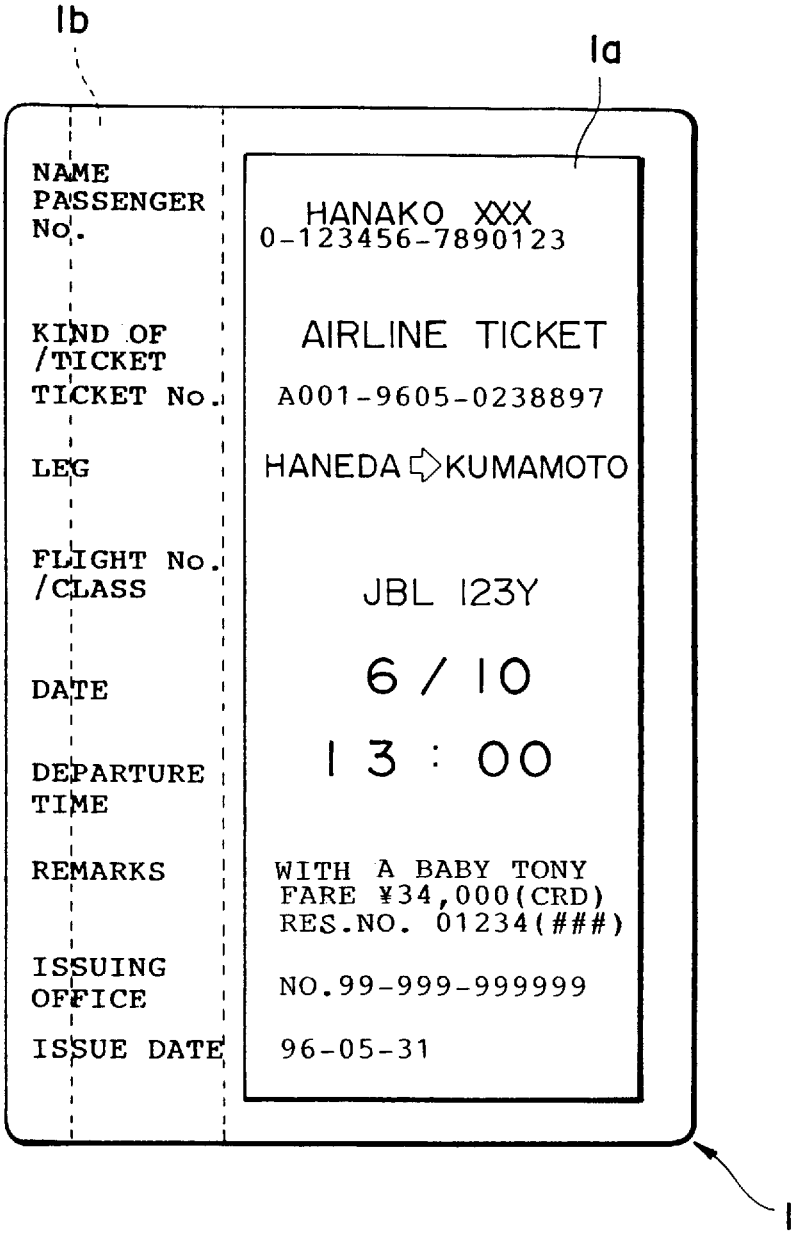
FIG. 4 is a front view of an example of a reservation airline ticket.

FIG. 4 shows an example of a reservation airline ticket. This reservation airline ticket 1 is formed by a reusable ticket 1 mentioned above, and the thermal print portion 1*a* of this ticket has a passenger's name, passenger No., flight name/class, date and time of departure, and so on printed thereon as reservation information.

On the other hand, the magnetic stripe 1*b* of the reservation airline ticket 1 has an information recording area in which reservation information such as the items mentioned above is recorded, and which indicates the number of times of printing done so far.

Figure 1:
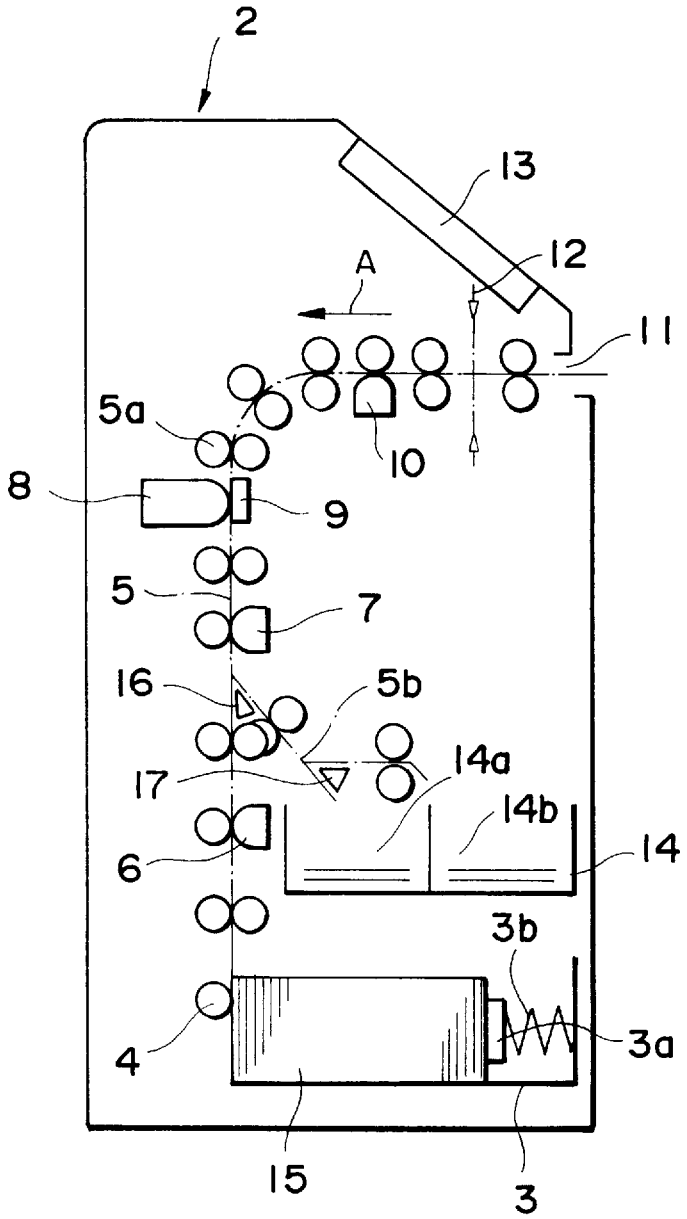
FIG. 1 is a schematic diagram of a ticket processing apparatus according to the present invention.

FIG. 1 is a schematic drawing of the ticket processing apparatus according to the present invention. This ticket processing apparatus 2 has at an upper position a ticket insertion port 11 for inserting a reservation airline ticket 1 to be reissued as a boarding ticket as described later. At the ticket insertion port 11, there is a transport path 5 running from top to bottom. Along the transport path 5, there are provided multiple pairs of transport rollers 5*a* and guide members, not shown, for holding and transporting a ticket. On that side of the transport path 5 where there is the ticket insertion port 11, an optical sensor 12 is provided, which includes a light-emitting element and a light-detecting element installed facing opposite to each other.

A magnetic read head 10, which is installed in the vicinity of the optical sensor 12, reads reservation information from the magnetic stripe 1*b* of the reservation airline ticket 1.

A thermal head 8 is mounted under the magnetic read head 10. The thermal head 8 is heated by controlled heating to delete the reservation information in the thermal print portion 1*a* of the reservation airline ticket 1 and print real-ticket information instead. The thermal head 8 has a platen 9 arranged opposite thereto with a predetermined distance apart therefrom, and the thermal head 8 is able to come into face-to-face contact with the thermal print portion 1*a* of the ticket.

A magnetic write head 7 is arranged lower than the thermal head 8. The magnetic write head 7 writes real-ticket information, the number of times of printing done, and the like on the magnetic stripe 1*b* of the reservation airline ticket 1 and so on.

A magnetic read head 6 is arranged further down the magnetic write head 7. The magnetic read head 6 reads the number of times of printing done from the magnetic stripe 1*b* of the boarding tickets 15, as described later.

A ticket storage 3 is arranged further down the magnetic read head 6. The ticket storage 3 is detachably inserted into the apparatus, and has a plurality of boarding tickets 15 in store are arranged upright in the vertical direction of the apparatus, each lying on its side. Those boarding tickets 15 are of the same structure as the reusable reservation airline ticket 1 shown in FIG. 3, and have the printed characters in the thermal print portion deleted in advance. The boarding tickets 15 on one side end of the ticket storage 3 are pressed against the other side end by a coil spring 3*b* and a pusher member 3*a*, while the boarding tickets on the other side end are pressed against a pay-off roller 4.

In the middle of the transport path 5, there is provided a branch path 5*b*. Blades 16 and 17 to guide a reservation airline ticket 1 to the branch path 5*b* are provided on each side of the branch path 5*b*. Those blades 16.17 are arranged rotatably for preset angles. A collection box 14 is installed right under the branch path 5*b*. This collection box 14 is divided into a reusable ticket collection partition 14*a* for collecting reservation airline tickets 1 which are reusable but have dust adhering thereto and a non-reusable ticket collection partition 14*b* for collecting non-reusable reservation airline tickets 1. The collection box 14 is detachably inserted into the apparatus.

An input operation unit 13 is provided at an upper position of the ticket processing apparatus 2. This input operation unit 13 includes keys for entering specified data and a display for image display.

Figure 2:
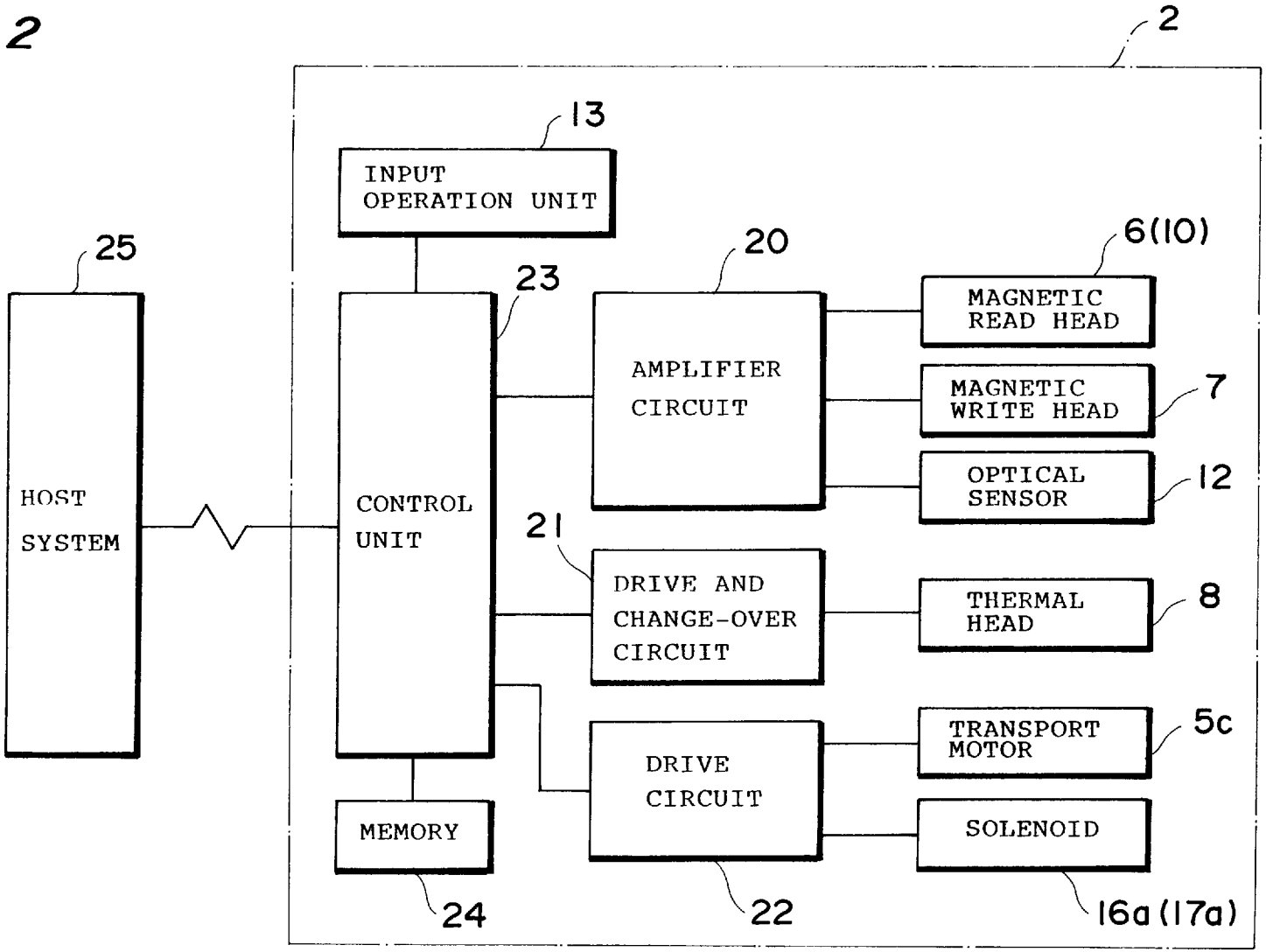
FIG. 2 is a control block diagram of the ticket processing apparatus.

FIG. 2 is a control block diagram of the ticket processing apparatus according to the present invention.

The ticket processing apparatus 2 includes a control unit 23. The control unit 23 controls component parts of the apparatus, and the control unit 23 is connected to an amplifier circuit 20. The amplifier circuit 20 has its amplification degree controlled by the control unit 23 and outputs a predetermined drive current. More specifically, the amplifier circuit 20 supplies predetermined drive currents to the magnetic read heads 6, 10, the magnetic write head 7, and the optical sensor 12 mentioned above.

The control unit 23 is connected to a drive and change-over circuit 21, which is connected to the thermal head 8. The drive and change-over circuit 21 is changed over by the control unit 23 and outputs a drive current in two levels. Thus, the thermal head 8, when heated to a write temperature, prints and, when heated to a delete temperature, deletes the printed characters and so on, as will be described later.

Further, the control unit 23 is connected to a drive circuit 22, which is connected to a transport motor 5*c* and solenoids 16*a* and 17*a*. The drive circuit 22, controlled by the control unit 23, supplies a drive current to the transport motor 5*c*, which drives predetermined transport rollers 5*a* to transport a reservation airline ticket 1 or a boarding ticket 15. The solenoids 16*a* and 17*a*, controlled by the control unit 23, rotate the blades 16 and 17 to guide a reservation airline ticket 1 to the branch path 5*b*.

The control unit 23 is connected to a memory 24. The memory 24 formed by a RAM, ROM or the like contains a program for controlling the whole apparatus, and temporarily stores reservation information read from the magnetic stripe 1*b* of a reservation airline ticket 1, or a real-ticket information and the like sent from the host system 25.

The host system 25 is formed by a host computer which centrally manages the reservation and issuance of airline tickets.

Figure 5:
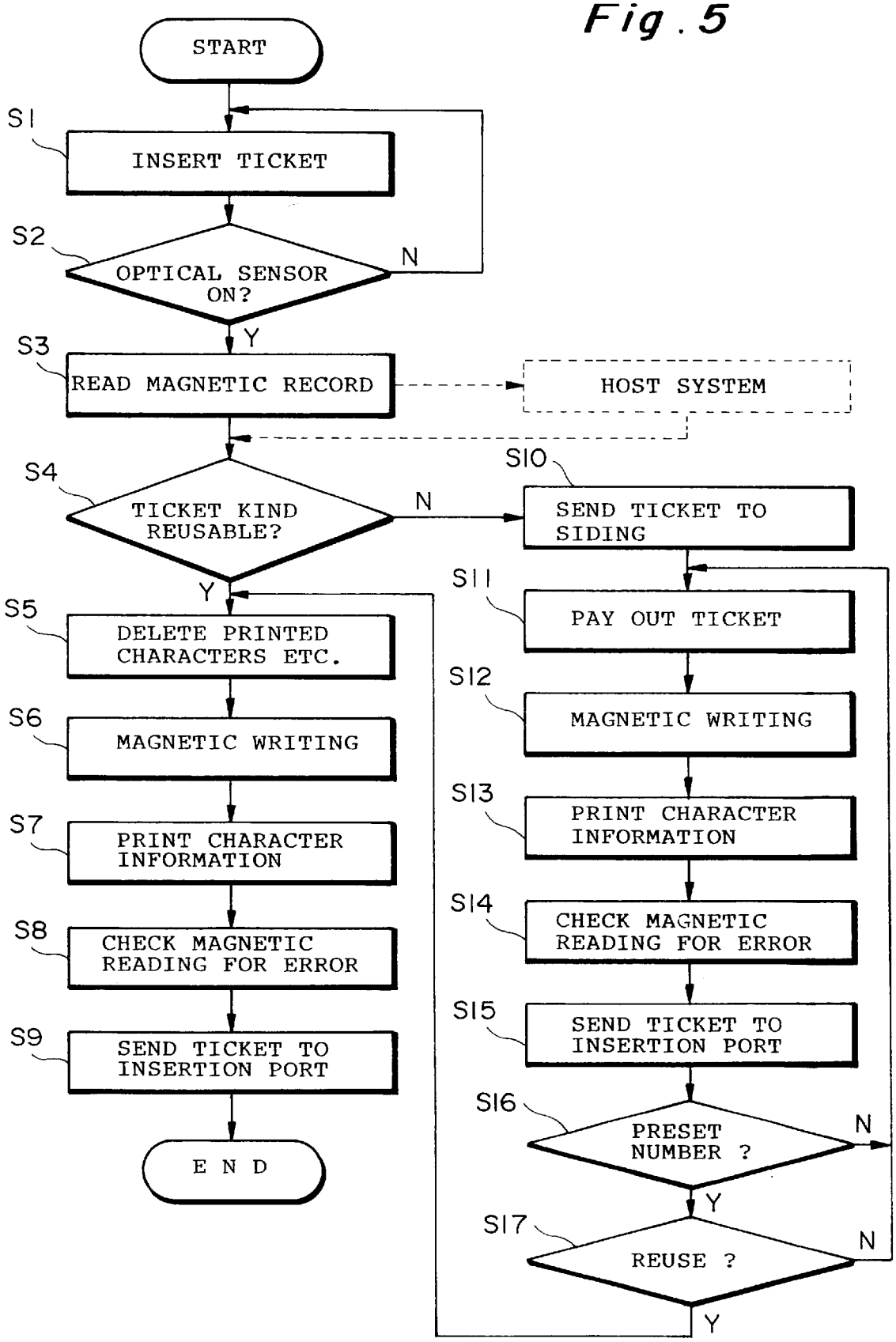
FIG. 5 is a operation flowchart of the ticket processing apparatus.

The operation of the ticket processing apparatus according to the present invention will be described with reference to the process flowchart in FIG. 5.

When a reservation airline ticket 1 is inserted into the ticket insertion port 11 (step S1), the quantity of light received by the light-detecting element (S2) of the optical sensor 12, and the control unit 23 decides that a ticket has been inserted and actuates the drive circuit 22. Therefore, the transport motor 5*c* rotates the transport rollers 5*a*, so that a reservation airline ticket 1 is transferred in the direction of the arrow A on the transport path 5, and brought into the apparatus 2.

When the reservation airline ticket 1 comes to the position of the magnetic read head 10, the magnetic read head 10 reads reservation information and information about the number of times of printing done on the magnetic stripe 1*b* (S3), and sends these items of information to the control unit 23. The control unit 23 sends the reservation information and the information about the number of times of printing done to the memory 24 for temporary storage there, and at the same time sends the reservation information to the host system 25.

Figure 8:
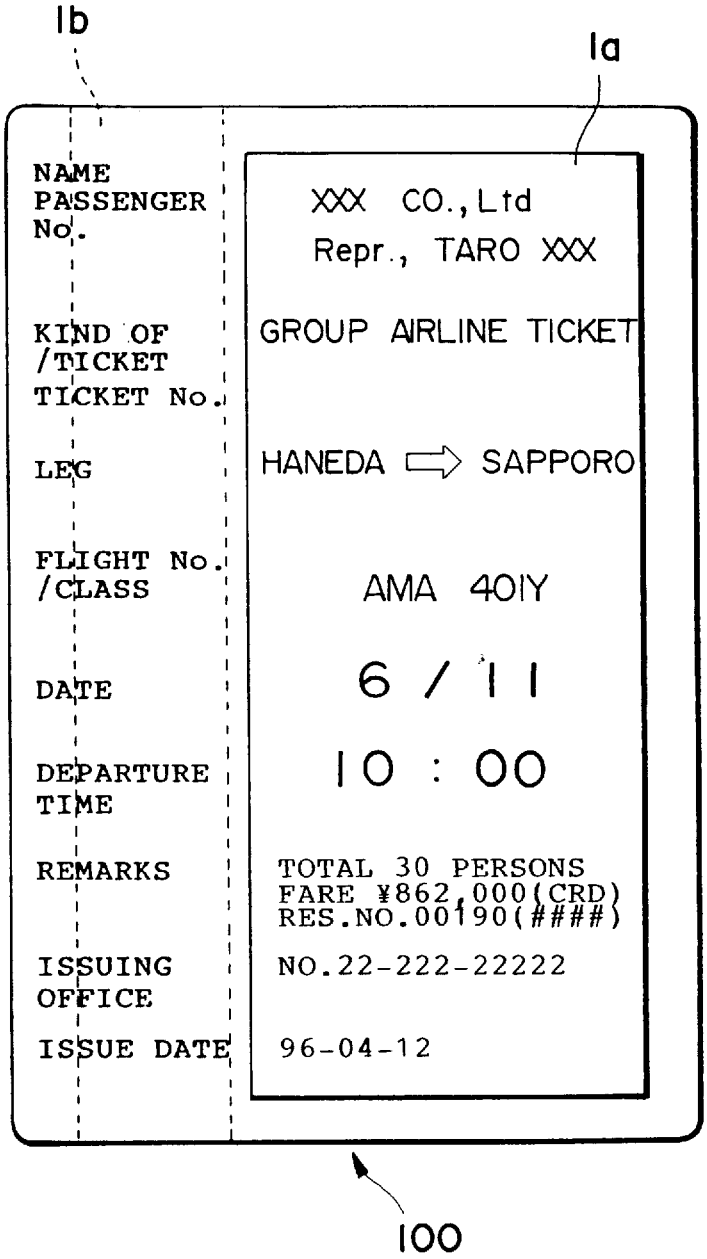
FIG. 8 is a front view of a group reservation airline ticket.
Figure 9:
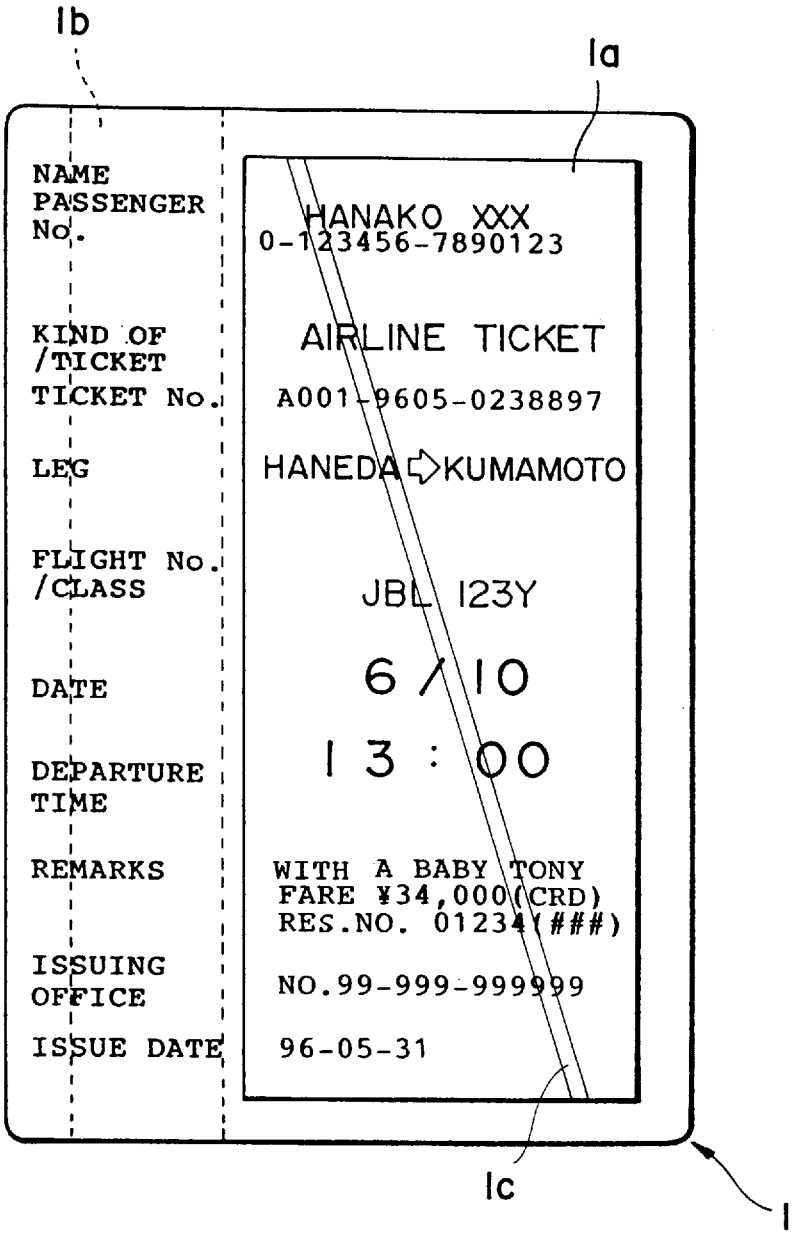
FIG. 9 is a front view of a boarding ticket that has become not reusable.

The control unit 23 makes a decision on the ticket kind, specifically, it decides from the reservation information whether the inserted reservation airline ticket 1 is an ordinary reservation ticket or a group reservation airline ticket (see FIG. 8). The control unit 23 decides from the information about the number of printing done whether the ticket is reusable or not (S4).

If the reservation airline ticket 1 is an ordinary reservation ticket and reusable, the control unit 23 further transports the reservation airline ticket 1 to the thermal head 8, and controls the drive and change-over circuit 21 to supply current to the thermal head 8 to heat it to a deletion temperature. On account of this, the reservation information printed in the thermal print portion 1*a* of the reservation airline ticket 1 is deleted (S5).

On the other hand, the control unit 23 receives from the memory 24 the real-ticket information sent from the host system 25, and supplies the real-ticket information and information about the number of times of printing done added with "1" to the magnetic write head 7. Therefore, the items of information for a "boarding ticket", such as a flight name, seat, boarding gate and so on along with information about an updated number of printing done are written in the magnetic stripe 1*b* of a reservation airline ticket 1 by the magnetic write head 7 (S6).

Figure 7:
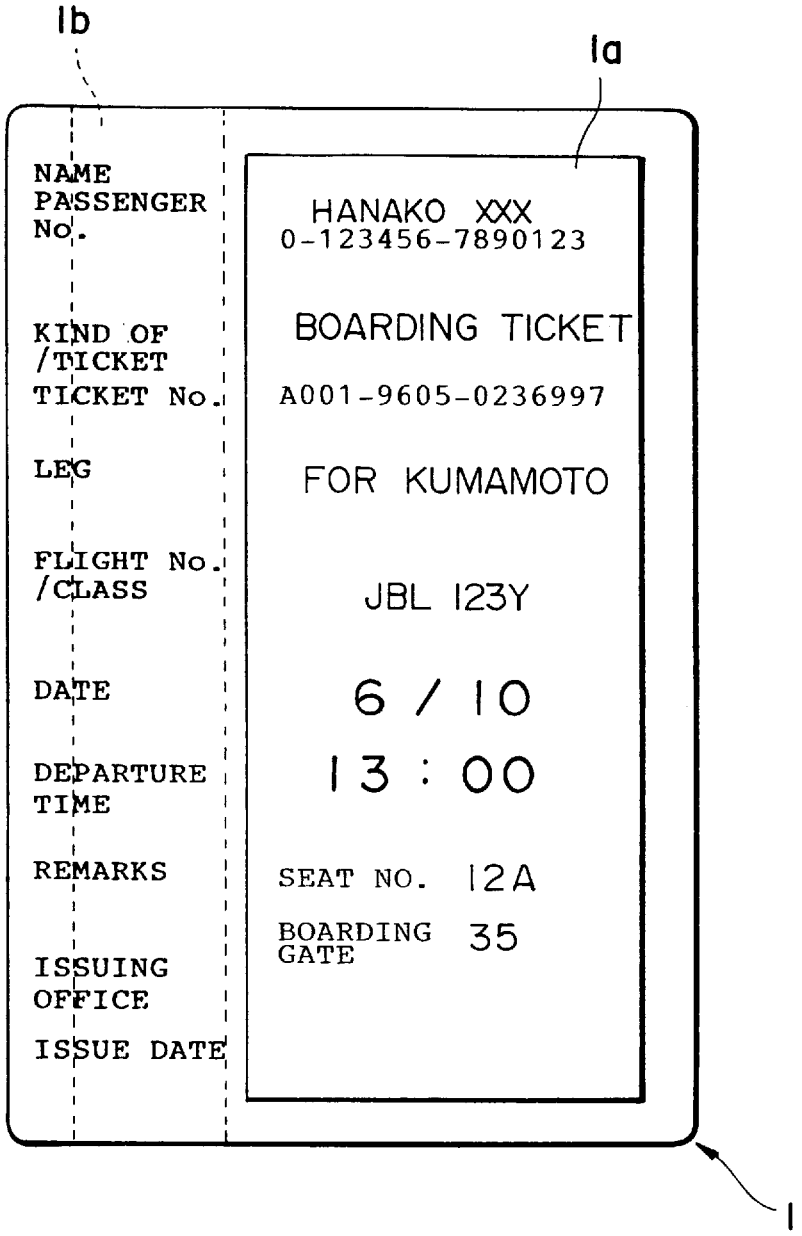
FIG. 7 is a front view of a post-conversion boarding ticket according to the present invention.

The control unit 23 reverses the transport direction of the reservation airline ticket 1 to send it to the thermal head 8. The control unit 23 sends real-ticket information to the thermal head 8 and controls the thermal head 8 so that it is heated to a write temperature. In this way, the above-mentioned items of "boarding ticket" information are printed on the thermal print portion 1*a* of the reservation airline ticket 1 and therefore the reservation airline ticket 1 is reused as a boarding ticket 15 as shown in FIG. 7 (S7).

The control unit 23 causes this boarding ticket 15 to move to the magnetic read head 10, and causes this read head 10 to read the real-ticket information written on the magnetic stripe 1*b*, and by comparing this real-ticket information with real-ticket information received from the host system 25, checks that there is no error (S8), and causes the boarding ticket 15 to be transported to the ticket insertion port 11 to eject the ticket (S9).

The information stored in the memory 24 is eventually deleted, but the results of processing are retained as they are printed in a detailed statement in the apparatus.

When a group reservation airline ticket 100 shown in FIG. 8 is inserted, the control unit 23 reads reservation information from the magnetic stripe 1*b* (S3), and at step S4, decides that the ticket 100 is a group reservation ticket, and causes the drive circuit 22 to energize the solenoid 16*a* to rotate the blade 16. Accordingly, the group reservation airline ticket 100 is guided to the branch path side 5*b* for a temporary siding (S10). After this, the solenoid 16*a* is de-energized to bring the blade 16 to the original position.

The control unit 23 controls a rotating mechanism, not shown, to rotate the pay-out roller 4 on the ticket storage 3 side to cause a stored boarding ticket 15 to be paid out upwardly from the ticket storage 3 (S11). Then, the control unit 23 controls the magnetic read head 6 to read the information about the number of printing done from the magnetic stripe 1*b* of the boarding ticket 15, and store the information in the memory 24.

Subsequently, the control unit 23 causes the boarding ticket 15 to be transported to the magnetic write head 7. Since the magnetic write head 7 is supplied with the above-mentioned real-ticket information and the information about the number of printing done added with "1", these items of information are written in the magnetic stripe 1*b* of the boarding ticket 15 (S12).

Then, the boarding ticket 15 is transported to the thermal head 8 just as mentioned above, where "boarding ticket" information is printed on the thermal print portion 1*a* (S13), and the real-ticket information is read by the magnetic read head 10 into the magnetic stripe 1*b* and the information that has been read is checked (S14) for any error, and the boarding ticket 15 is ejected from the ticket insertion port 11 (S15).

Since the control unit 23 possesses information about the number of issued tickets (30 persons for example) obtained from reservation information of a group reservation airline ticket 100, and repeatedly executes the steps S1 to S15 until the 29th boarding ticket has been issued from the tickets in store (S16), and decides whether or not the ticket 100 in question is reusable or not from the information about the number of printing done in the group reservation airline ticket 100 which has been in the siding path (S17).

If the decision is that the ticket 100 is reusable, the control unit 23 causes the solenoid 16*a* to be energized to rotate the blade 16 to have the group reservation airline ticket 100 in the siding path return to the transport path 5, and executes the steps S5 to S9. Consequently, the group reservation airline ticket 100 can be reused as the last boarding ticket.

If the number of times of printing done of a group reservation airline ticket 100 is found to be 1,000, for example, the control unit 23 decides that the ticket is not reusable, and executes the steps S11 to S15, with which the ticket issuing process for a boarding ticket 15, which has been in store, is finished.

Next, when at step S4 the magnetic read head 10 reads the number of times of printing done from the magnetic stripe 1*b* of a reservation airline ticket 1 or a group reservation airline ticket 100, if the number of times of printing done is "1,000", the control unit 23 decides that the ticket is not reusable, and causes the reservation airline ticket 1 or the group reservation airline ticket 100 which has been in the siding path to go to the thermal head 8.

The thermal head 8, controlled by the control unit 23, prints a slanted line 1*c* on the thermal print portion 1*a* of the reservation airline ticket 1 (or the group reservation airline ticket 100).

Then, this reservation airline ticket 1(100) has an indication that the ticket is not reusable written on the magnetic stripe 1*b* by the magnetic write head 7.

As the solenoids 16*a* and 17*a* are energized to rotate the blades 16 and 17, this reservation airline ticket 1(100) is guided to the branch path 5*b* and collected in the collection partition 14*b* of the collection box 14.

Incidentally, the reservation airline ticket 1 or the like may be marked with "VOID" or "INVALID" or magnetic writing may be omitted.

If the reservation airline ticket 1 or the like is bent or stained so heavily as not to be reusable, the person in charge manipulates the input operation unit 13 to input a collection command. On receiving a collection command, the control unit 23 causes the reservation airline ticket 1 or the like to be guided into the branch path 5*b* and collected into the collection partition 14*b* of the collection box 14 as described above.

Figure 6:
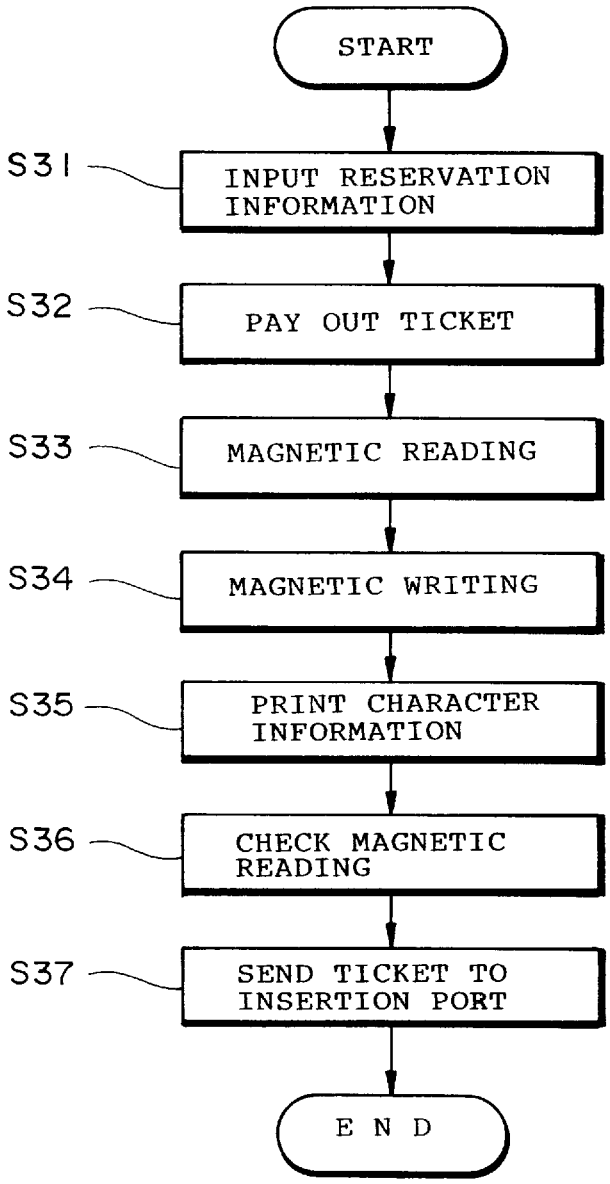
FIG. 6 is a flowchart of the issuance and processing of a new ticket according to the present invention.

On the other hand, when a reservation airline ticket 1 is collected due to contamination or the like as mentioned above, the person in charge manipulates the input operation unit 13 to input reservation information (S31) as shown in FIG. 6. The control unit 23 sends this reservation information to the host system 25, and receives real-ticket information from the host system 25. Moreover, when a decision is made that the number of printing done on the reservation airline ticket 1 is 1,000 and the ticket is not reusable, the control unit 23 sends the reservation information, which it read from the magnetic stripe 1*b* of the airline ticket 1, to the host system 25, and receives real-ticket information from the host system 25 in the same way as mentioned above.

Then, the control unit 23 causes the pay-out roller 4 on the ticket storage 3 to rotate to pay out a boarding ticket 15 upwardly from the ticket storage 3 (S32), controls the magnetic read head 6 so that it read the number of times of printing done from the magnetic stripe 1*b* of the boarding ticket 15 (S33) and store this information in the memory 24.

Next, the control unit 23 causes the boarding ticket 15 to move to the magnetic write head 7. Since the magnetic write head 7 is supplied with real-ticket information and information about the number of printing done added with "1", these items of information are written on the magnetic stripe 1*b* of the boarding ticket 15 (S34).

Thereafter, the boarding ticket 15 is transported to the thermal head 8, and "boarding ticket" information is printed on the thermal print portion 1*a* (S35), the real-ticket information of the magnetic stripe 1*b* is read by the magnetic read head 10 to check the information (S36) for any error, and the boarding ticket 15 is ejected from the ticket insertion port 11 (S37).

According to the ticket processing apparatus in the present invention, an inserted reservation airline ticket 1 or group reservation airline ticket 100 is converted into a boarding ticket, which is issued to the customer. This makes it possible to configure both the ticket storage 3 for accommodating boarding tickets 15 in store and the collection box 14 in small sizes, so that the size of the apparatus itself can be decreased.

In addition, the number of boarding tickets 15 to be in store is reduced and the number of reservation airline tickets 1 to be collected is also reduced. Consequently, the work to replenish and collect tickets is decreased, which is advantageous in ticket management.

Figure 10:
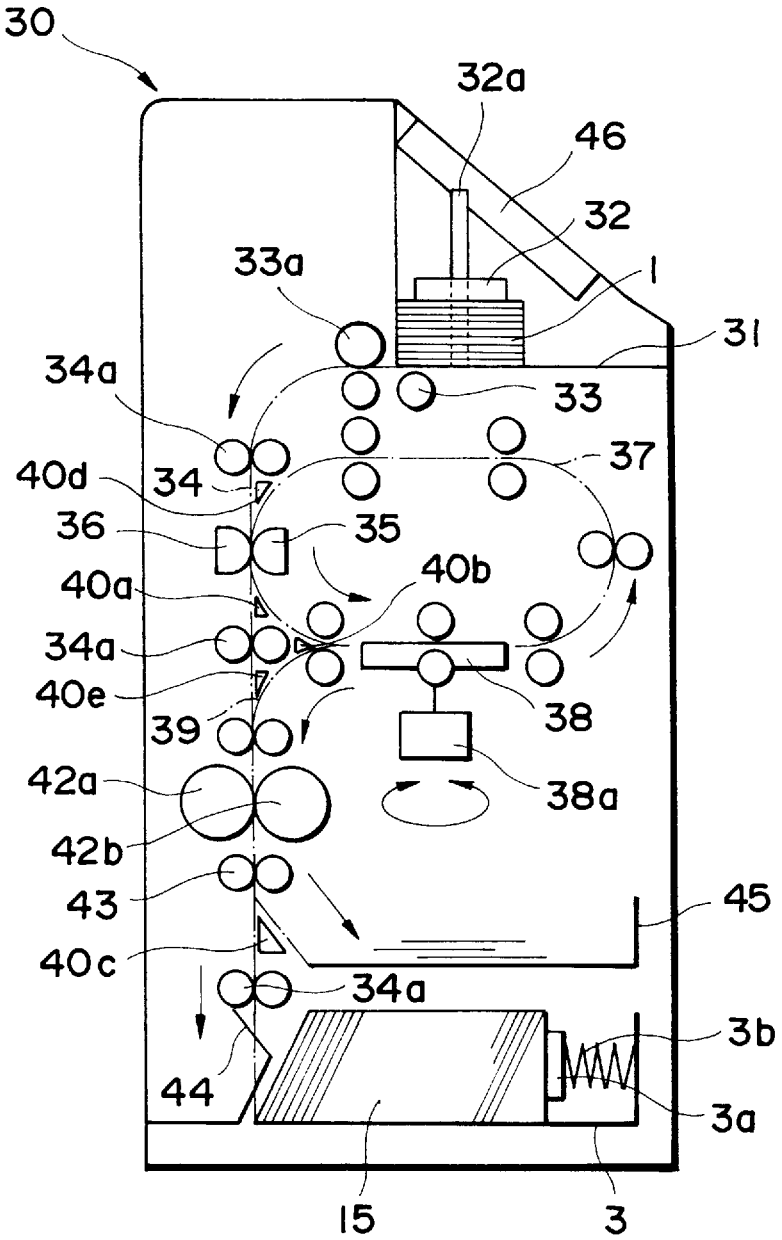
FIG. 10 is a schematic diagram of a ticket regenerating apparatus according to the present invention.

FIG. 10 is a schematic diagram of the ticket regenerating apparatus according to the present invention. This ticket regenerating apparatus 30 regenerates the above-mentioned used and collected boarding tickets 15 and collected usable reservation airline tickets 1 (hereafter referred to as reusable tickets 1), and automatically stores those tickets in a ticket storage 3.

The ticket regenerating apparatus 30 includes a stage 31, which has mounted thereon reusable tickets 1 to be regenerated, and a weight 32, which is placed on the reusable tickets 1 and vertically movable along a guide shaft 32*a*. The ticket regenerating apparatus 30 presses the lowest reusable ticket 1 downward against the intake roller 33 beneath the stage 31, through the intermediary of the weight 32.

A reverse roller 33*a* is arranged near the intake roller 33. If more than one reusable ticket 1 are taken in by the intake roller 33, the reverse roller 33*a* brings tickets other than the lowest ticket back to the original position.

A transport path 34 is extending down warily from the reverse roller 33*a*. Along the transport path 34, there are arranged multiple pairs of transport rollers 34*a* and guide members, not shown.

First and second magnetic read heads 35 and 36 are arranged facing each other in the middle of the transport path 34. A transport path loop 37 is formed in such a way as to branch out from the transport path 34. The bottom portion of the transport path loop 37 is formed by a turntable 38. The turntable 38 is rotated 180 degrees by a turn motor 38*a* formed by a stepping motor. A branch path 39 shoots off from the transport path loop 37 towards the transport path 34.

Blades 40*a*, 40*b*, 40*d* and 40*e* are arranged at the branch-out and joining points between the transport path 34, the transport path loop 37 and the branch path 39.

Cleaning rollers 42*a* and 42*b* are arranged facing each other under the branch path 39. Those cleaning rollers 42*a* and 42*b* are covered on their surfaces with a friction material such as rubber, and are rotated by a transport force smaller than that of the transport rollers 34*a*.

Heating rollers 43 are arranged under the cleaning rollers 42*a* and 42*b*. The heating rollers 43 are used to delete the printed characters in the thermal print portion 1*a* of a reusable ticket 1, and transport the ticket 1 while it is held between them.

A reject box 45 is arranged under the heating rollers 43. This reject box 45 is used to collect the ticket 1 by rotating the blade 40*c* when magnetic information cannot be read from the magnetic stripe 1*b* of the reusable ticket 1.

A ticket storage 3 is arranged under the reject box 45. This ticket storage 3 has the same structure as that of the apparatus in FIG. 1, and a V-shaped guide member 44 is arranged at the opening on one side of the ticket storage 3. This guide member 44 is used to guide a reusable ticket 1 into the ticket storage 3.

In FIG. 10, located at 46 is an input operation unit which has operation keys and a display provided therein.

Figure 11:
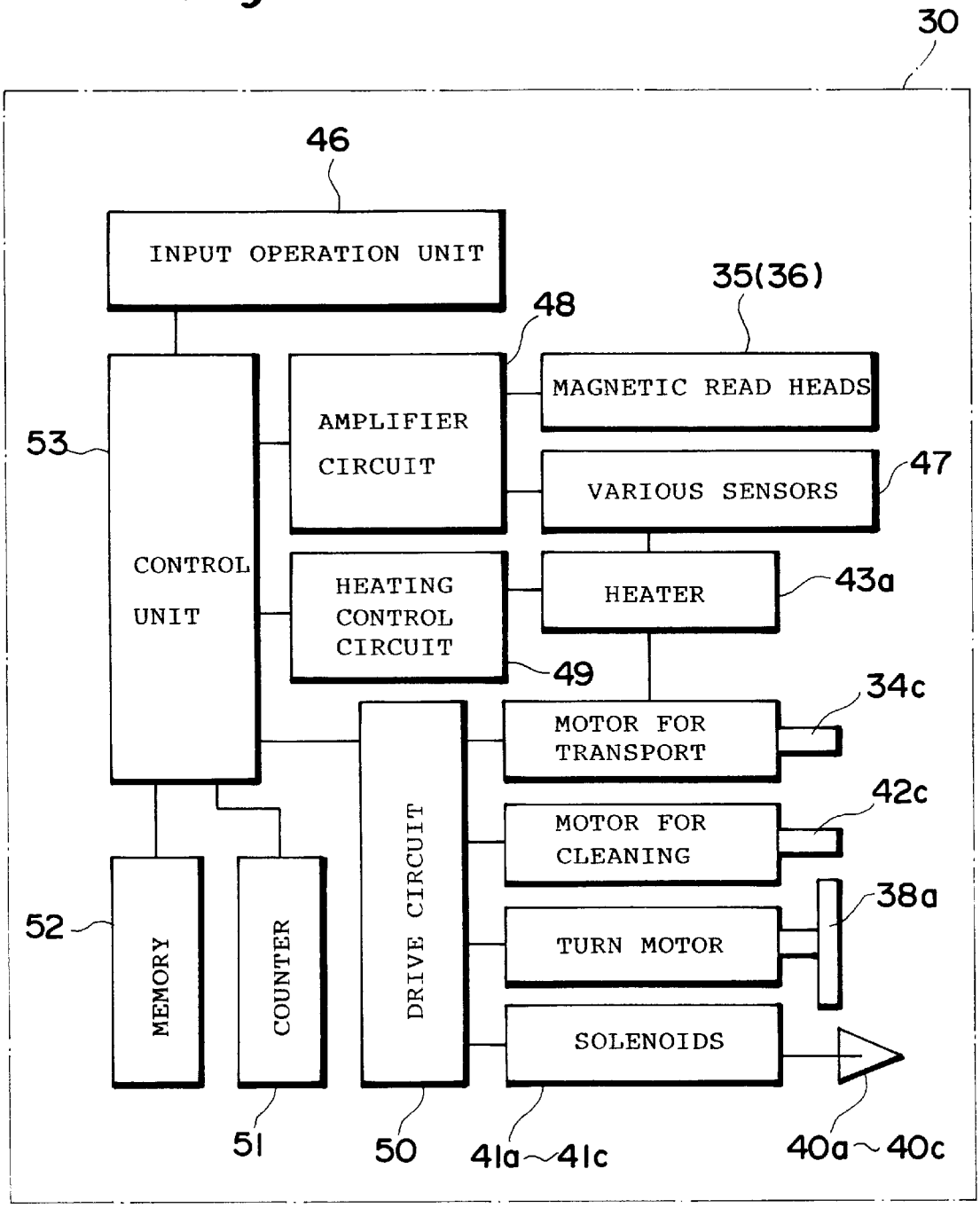
FIG. 11 is a control block diagram of the ticket regenerating apparatus according to the present invention.

FIG. 11 is a block diagram of the ticket regenerating apparatus 30 according to the present invention. This ticket regenerating apparatus 30 includes a control unit 53. The control unit 53, which controls the component parts of the apparatus 30, is connected to an amplifier circuit 48, which is connected to magnetic read heads 35 and 36, and various sensors 47.

The control unit 53 is connected to a heating control circuit 49, which is connected to heaters 43*a* contained in the heating rollers 43.

Further, the control unit 53 is connected to a drive circuit 50, which is connected to a transport motor 34*c*, a motor for cleaning 42*c*, a turn motor 38*a* and solenoids 41*a* to 41*c*.

Further, the control unit 53 is connected to a counter 51 and a memory 52. The counter 51 counts the number of taken-in reusable tickets 1, the number of tickets collected into the reject box 45, and so on. The memory 52 is used to store a program for controlling the apparatus 30, and hold the counts of tickets 1.

Figure 12:
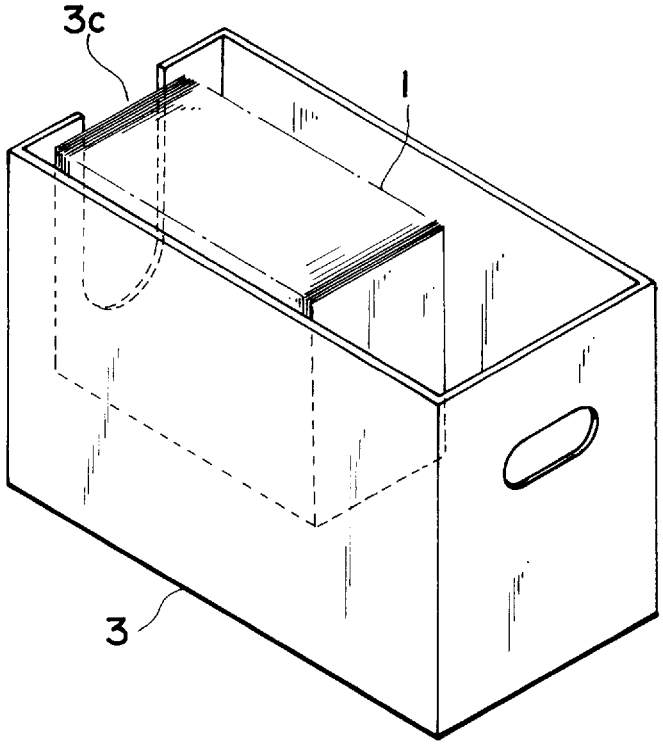
FIG. 12 is a perspective view of a ticket storage.

The ticket storage 3, which has a U-shaped cutout space 3*c* formed in the wall on one side, is mounted with the above-mentioned guide member 44 projecting through that cutout space 3*c* as shown in FIG. 12.

Figure 16:
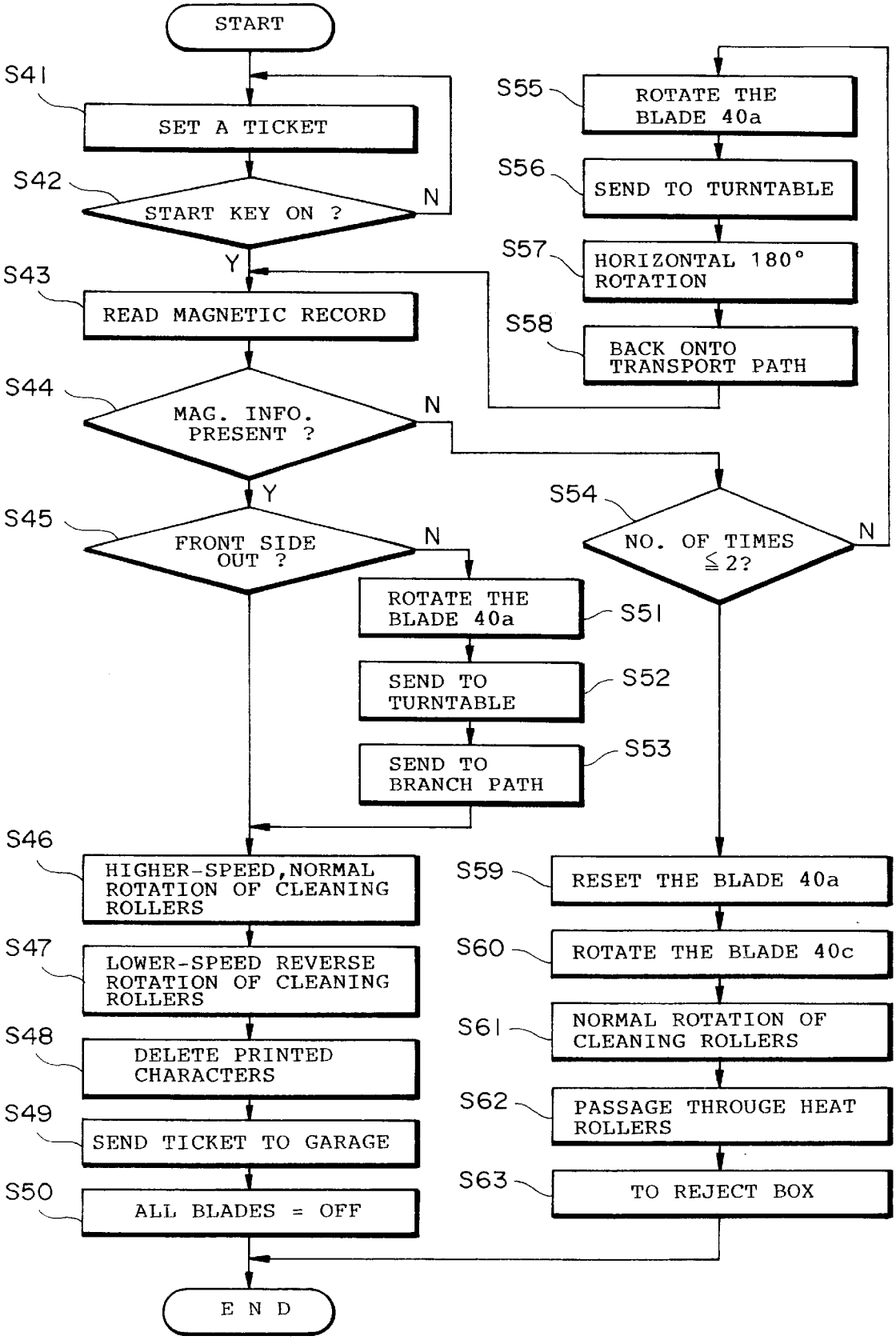
FIG. 16 is an operation flowchart of the ticket regenerating apparatus according to the present invention.

The operation of the ticket regenerating apparatus 30 according to the present invention will be described with reference to FIG. 16.

Reusable tickets 1 or the like which were used and collected at the boarding gate, for example, (hereafter called as tickets 1) are stacked on the stage 31, and a weight 32 is placed on the tickets 1 (step S41), and a start key, not shown, in the input operation unit 46 is depressed (S42).

Figure 13:
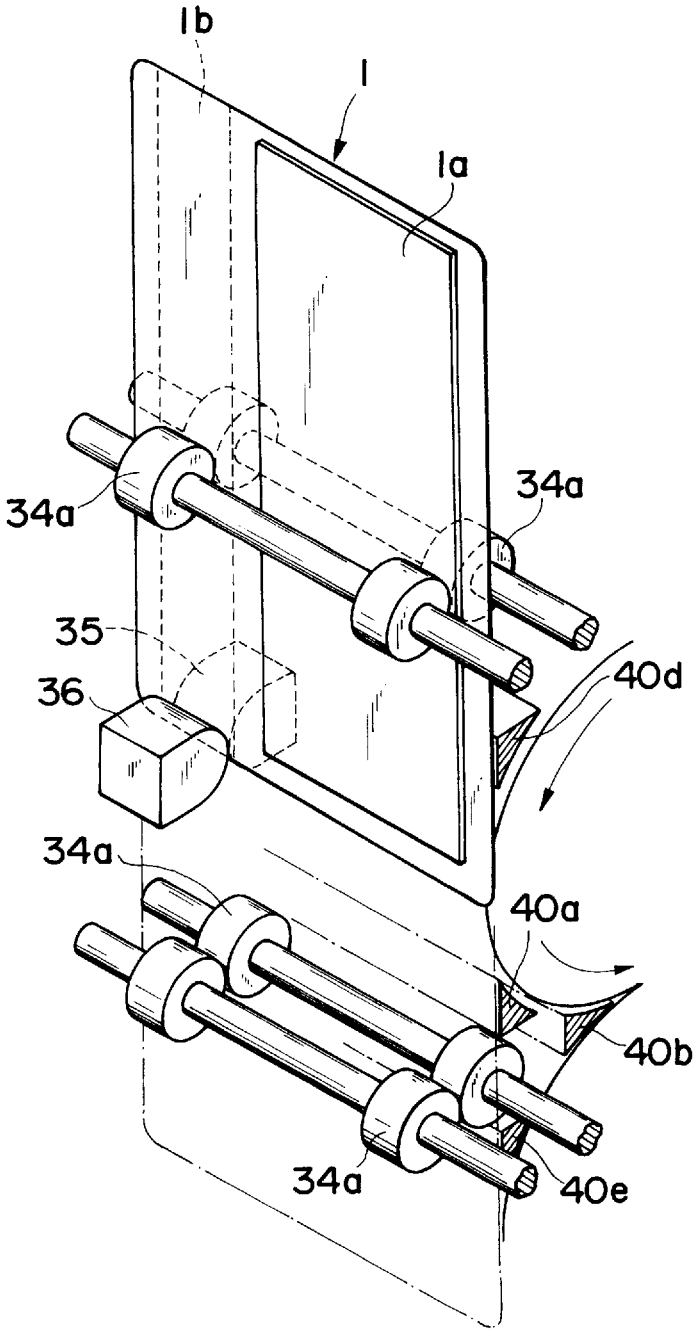
FIG. 13 is a perspective view showing the relative position of a ticket and the magnetic read heads of the ticket regenerating apparatus according to the present invention.

Thus, the control unit 53 controls the drive circuit 50 to drive the transport motor 34*c* and the drive motor (not shown) for the intake roller 33 to bring a ticket 1 into the apparatus 30, and transport to the magnetic read heads 35 and 36 as shown in FIG. 13.

The magnetic read head 35 or 36 reads five or six bits, for example, of magnetic information from the magnetic stripe 1*b* of the ticket 1 (S43).

When the magnetic read head 35 or 36 could read magnetic information either with the magnetic head 35 or 36, the control unit 53 decides that magnetic information is present (S44), which means that the ticket 1 has been inserted with the magnetic stripe 1*b* facing the read head.

Figure 14:
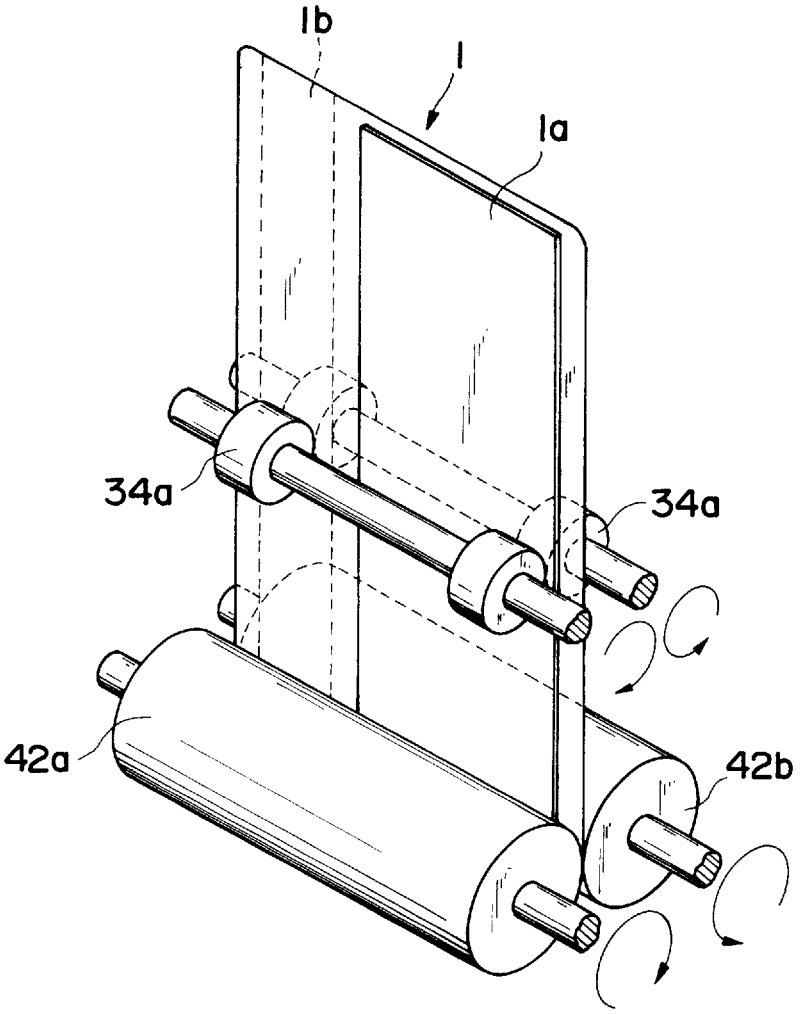
FIG. 14 is a perspective view showing the relative position of a ticket and the cleaning rollers of the ticket regenerating apparatus.

Then, when magnetic information is sent from the magnetic read head 35, the control unit 53 decides that the ticket 1 is placed in "normal position" (S45), and causes the ticket 1 to be transferred to the cleaning rollers 42*a* and 42*b* (see FIG. 14).

Then, the control unit 53 drives the cleaning motor 42*c* to rotate the cleaning rollers 42*a* and 42*b* at a peripheral speed higher than the peripheral speed of the transport rollers 34*a*. Due to the difference between the two peripheral speeds, the cleaning rollers 42*a* and 42*b* race a little relative to the movement of the ticket, so that the a half area of each of the front and reverse faces of the ticket 1 is cleaned (S46).

Figure 15:
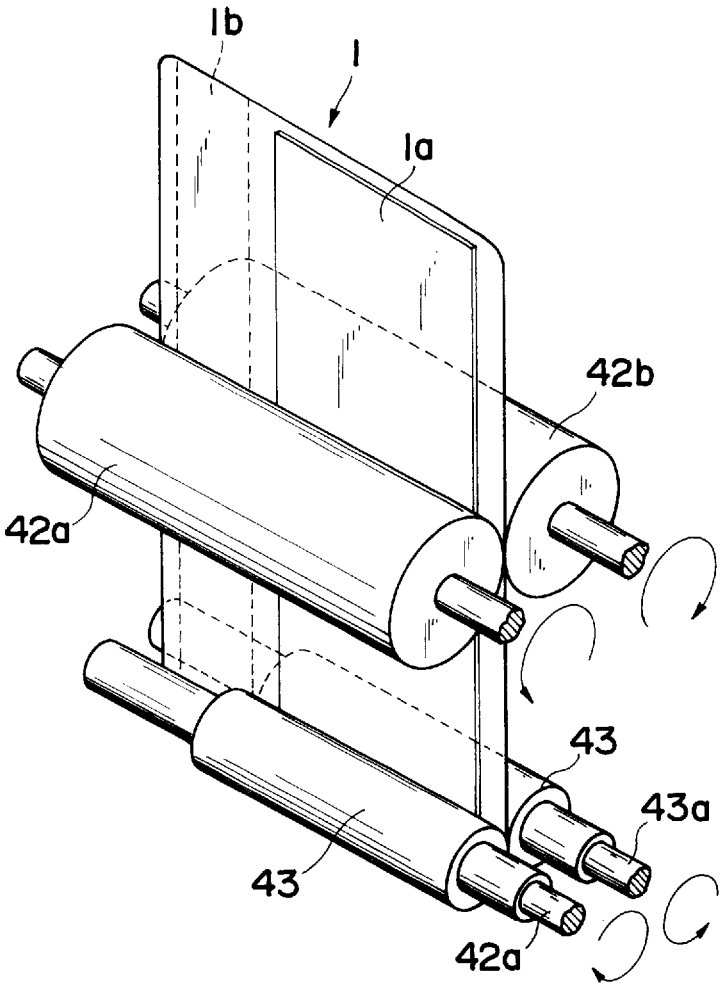
FIG. 15 is a perspective view showing the cleaning rollers and the heating rollers of the ticket regenerating apparatus according to the present invention.

Then, as shown in FIG. 15, when the leading edge of the ticket 1 reaches the heating rollers 43, the control unit 53 stops the rotation of the cleaning rollers 42*a* and 42*b*, and causes the cleaning rollers to rotate at low speed in the opposite direction (S47), and at the same time causes the transport motor 34*c* to move as the drive source to rotate the heating rollers 43 and 43 at a greater peripheral speed in the normal direction. The ticket 1 is thereby transported by the heating rollers 43 and 43 and the remaining half area of each of the front and reverse faces of the ticket 1 is cleaned.

Subsequently, when the ticket 1 is transported by the heating rollers 43 and 43, by the heat of the heaters 43*a* and 43*a* of the heating rollers 43 and 43, the printed characters and the like on the thermal print portion 1*a* of the ticket 1 are deleted (S48).

As the ticket 1 is further transported, the ticket 1 comes into contact with the guide member 44, and by its slanted face, the ticket 1 is guided into the ticket storage 3 (S49).

After this, the control unit 53 de-energizes the solenoids to bring the blades to the original positions (S50), causes the counter 51 to add "1" to the number of tickets stored in the ticket storage 3, updates the addition data in the memory 52, and causes the display of the input operation unit 46 to show the number of stored tickets.

Meanwhile, when at step S45 the magnetic read head 36 reads magnetic information of the ticket 1, the control unit 53 decides that the ticket 1 is in "reversed position", the solenoid 41*a* is energized to rotate the blade 40*a* (S51). Therefore, the ticket 1 goes into the transport path loop 37 from the transport path 34, and the ticket 1 is transported onto the turntable 38, and is positioned (S52).

Then, the control unit 53 energizes the solenoid 41*b* to rotate the blade 40*b* to transport the ticket 1 from the turntable 38 to the branch path 39 (S53) and bring the ticket 1 back to the transport path 34. By this operation, the ticket 1 is turned upside down so that the ticket 1 is in "normal position."

Subsequently, the process moves to steps S46 to S50, by which the ticket 1 is stored in the ticket storage 3.

If at step S44 neither the magnetic read head 35 nor 36 detects magnetic information, a decision is made that the magnetic stripe 1*b* of the ticket 1 is not. located at the side where the magnetic read heads 35 and 36 are provided, the ticket 1 is turned around by the turntable 38 for 180 degrees in a horizontal plane to change the left and right sides of the ticket 1.

More specifically, if at step S44 magnetic information is not detected, the control unit 53 controls the counter 50 to count the number of times of no detection of magnetic information (S54). Then, the solenoid 41*a* is energized to rotate the blade 40*a* (S55) so that a transport route is formed by the transport path 34 and the transport path loop 37, and the transport of the ticket 1 is resumed to send it onto the turntable 38 (S56). With the turntable 38 holding the ticket 1, the control unit 53 controls the turn motor 38*a* to turn the ticket 1 180 degrees in a horizontal plane (S57). In this case, the rotating direction may be either clockwise or counter-clockwise.

Then, the ticket 1 is transported upwardly on the transport path loop 37, and passes through the blade 40*b* back to the transport path 34 (S58). By this operation, the ticket 1 is back on the transport path 34 with the left and right sides changed.

Here, the step S43 mentioned above is performed, and if magnetic information cannot be detected once again (S44), a decision is made that the ticket 1 is devoid of the magnetic stripe 1*b*, and when the number of times of no detection of magnetic information on the ticket 1 in the counter 50 is incremented by 1, the number exceeds the predetermined number of times (twice) (S54), so that this ticket 1 is regarded as an abnormal ticket, and discarded into the reject box 45.

The blade 40*a* is reset to the original position to enable the abnormal ticket to be transported on the transport path 34 (S59). Concurrently, the solenoid 41*c* is energized to set the blade 40*c* turned at the branch-out point from the transport path 34 to the reject box 45 (S60).

Then, the control unit 53 causes the cleaning rollers 42*a* and 42*b* to rotate at the same peripheral speed as that of the transport rollers 34*a* (S61) so as not to clean the abnormal ticket. Subsequently, the abnormal ticket is made to pass through the heating rollers 43 and 43 (S62) and is stored in the reject box 45 (S63), and when detection means, not shown, detects that the abnormal ticket has been stored in the reject box 45, the process moves on to step S50.

The abnormal ticket may not have the printed characters and the like deleted by heating with the heating rollers 43 and 43, in which case the transport speed and the like can be increased.

In the meantime, in the magnetic record reading at step S43, if output of the magnetic read heads is extremely low, it is possible to perform such control as to clean the ticket once and then read magnetic information again.

In the above-mentioned embodiment, the magnetic read heads 35 and 36 are mounted facing each other, but it is of course possible to mount read/write heads, and if a predetermined level of magnetic output cannot be obtained, make a decision whether the difficulty of obtaining a predetermined level of signal is due to the deterioration of the magnetic stripe or the problem on the side of the apparatus by writing some signal at a normal magnetic recording level on the ticket and letting the ticket make a round-trip of the transport path loop 37 and reading the written signal. Needless to say, it is possible to start processing (receiving) the next ticket without waiting until the current ticket has been stored in the ticket storage 3 if the ticket 1 is set correctly in the right direction and the ticket 1 need not be turned over to change the front side and the reverse side or change the left side and the right side.

As is understood from the foregoing, the tickets 1 regenerated in the ticket regenerating apparatus 30 are recovered when the ticket storage 3 is dismounted. The regenerated tickets are loaded in the ticket processing apparatus in FIG. 1, or used as reservation tickets.

The ticket regenerating apparatus according to the present invention decides the direction of an inserted ticket from the position of detected magnetic information of the ticket, stores the tickets in the ticket storage, with the four, front, reverse, left and right sides of all tickets aligned to thereby obviate the need for the clerk to manually arrange each ticket in the same position, and uses the counter to count the number of tickets stored, thereby eliminates the need for the clerk to count, which is troublesome. Moreover, in the ticket regenerating apparatus, a ticket storage is adopted which is common with the ticket processing apparatus, so that it is possible to replenish stored tickets by the ticket storage box. As is obvious from the foregoing description, the present invention provides the apparatus with highly improved convenience.

What is claimed is:

1. A ticket processing apparatus for reusable tickets, having a thermal print portion capable of repeatedly printing by heating at a predetermined write temperature and deleting the printed characters and the like by heating at a deletion temperature, and also capable of setting information about the number of times of printing done, said ticket processing apparatus comprising:

printed-character-deletion heating means for deleting reservation information by heating a thermal print portion of a reservation ticket to a deletion temperature when a reusable reservation ticket on which reservation information has been printed is inserted;

reuse decision means for deciding whether or not said reservation ticket is reusable by reading said information about the number of times of printing done on said reservation ticket;

real ticket conversion means for, when said ticket is decided to be reusable by said reuse decision means, converting said reservation ticket into a real ticket by printing real-ticket information on said thermal print portion of said reservation ticket by controlling a thermal head, and issuing a real ticket;

storage means for storing a reusable ticket as a real ticket in store;

stored real ticket issuing means for, when said reuse decision means decides that said reservation ticket is not reusable, taking out a stored real ticket, and printing real-ticket information on said thermal print portion of said stored real ticket by controlling said thermal head; and number-of-times updating means for updating the number of times of printing done on a real ticket to be issued.

2. A ticket processing apparatus for reusable tickets according to claim 1, wherein said printed-character-deletion heating means includes said thermal head, and wherein said thermal head is controlled to heat said thermal print portion to said deletion temperature.

3. A ticket processing apparatus for reusable tickets according to claim 1, further comprising ticket collecting means for collecting said reservation ticket judged to be not reusable.

4. A ticket processing apparatus for reusable tickets according to claim 1, wherein said reusable ticket has a magnetic recording stripe where said information about the number of times of printing done is set.

5. A ticket regenerating apparatus for reusable tickets, having a thermal print portion capable of repeatedly printing by heating at a predetermined write temperature and deleting the printed characters and the like by heating at a deletion temperature, and also capable of setting information about the number of printing times, said ticket regenerating apparatus comprising:

ticket cleaning means for cleaning a surface of said reusable ticket;

printed-character-deletion heating means for deleting printed characters by heating said thermal print portion of a cleaned reusable ticket to said deletion temperature; and ticket storage means for storing said reusable tickets on which printed characters have been deleted by heating.

6. A ticket regenerating apparatus for reusable tickets according to claim 5, further comprising:

ticket direction deciding means for deciding a direction of an inserted ticket into said apparatus by detecting a magnetic recording stripe of said reusable ticket; and ticket direction correcting means for changing the direction of said reusable ticket to a predetermined insertion direction according to a decision of said ticket direction deciding means.

* * * * *